US006962897B2

(12) United States Patent
Küpper et al.

(10) Patent No.: US 6,962,897 B2
(45) Date of Patent: Nov. 8, 2005

(54) FLUORINE-CONTAINING LUBRICANTS

(75) Inventors: Stefan Küpper, Langenfeld (DE); Michael Schneider, Jüchen (DE); Walter Grosse Böwing, Dormagen (DE); Alfred Laufenberg, Dormagen (DE); Harald Kluschanzoff, Mettmann (DE)

(73) Assignee: Ecolab Inc., St. Paul, MN (US)

( * ) Notice: Subject to any disclaimer, the term of this patent is extended or adjusted under 35 U.S.C. 154(b) by 21 days.

(21) Appl. No.: 10/356,034

(22) Filed: Jan. 30, 2003

(65) Prior Publication Data

US 2003/0139305 A1 Jul. 24, 2003

Related U.S. Application Data

(62) Division of application No. 09/655,544, filed on Sep. 6, 2000, now Pat. No. 6,653,263.

(30) Foreign Application Priority Data

Sep. 7, 1999 (DE) ..... 199 42 535

(51) Int. Cl.[7] ..... C10M 173/00
(52) U.S. Cl. ..... 508/582; 508/589; 508/579; 508/590
(58) Field of Search ..... 508/582, 589, 508/579, 590

(56) References Cited

U.S. PATENT DOCUMENTS

| | | | |
|---|---|---|---|
| 3,011,975 | A | 12/1961 | Nitzsche et al. |
| 3,213,024 | A | 10/1965 | Blake et al |
| 3,514,314 | A | 5/1970 | Nemeth et al. |
| 3,664,956 | A | 5/1972 | Messina et al. |
| 3,758,618 | A | 9/1973 | Deem |
| 3,853,607 | A | 12/1974 | Iyengar et al. |
| 3,860,521 | A | 1/1975 | Aepli et al. |
| 3,981,812 | A | 9/1976 | Zletz |
| 4,069,933 | A | 1/1978 | Newing |
| 4,105,716 | A | 8/1978 | Sakai et al. |
| 4,149,624 | A | 4/1979 | Douty et al. |
| 4,162,347 | A | 7/1979 | Montgomery |
| 4,248,724 | A | 2/1981 | MacIntosh |
| 4,264,650 | A | 4/1981 | Schulze et al. |
| 4,289,671 | A | 9/1981 | Hernandez |
| 4,324,671 | A | 4/1982 | Christian et al. |
| 4,436,200 | A | 3/1984 | Hodlewski et al. |
| 4,478,889 | A | 10/1984 | Maruhashi et al. |
| 4,486,378 | A | 12/1984 | Hirata et al. |
| 4,515,836 | A | 5/1985 | Cobbs, Jr. et al. |
| 4,525,377 | A | 6/1985 | Nickel et al. |
| 4,534,995 | A | 8/1985 | Pocock et al. |
| 4,538,542 | A | 9/1985 | Kennon et al. |
| 4,543,909 | A | 10/1985 | Sharpless |
| 4,555,543 | A | 11/1985 | Effenberger et al. |
| 4,569,869 | A | 2/1986 | Kushida et al. |
| 4,573,429 | A | 3/1986 | Cobbs, Jr. et al. |
| 4,632,053 | A | 12/1986 | Villanueva et al. |
| 4,652,386 | A | 3/1987 | Alberts et al. |
| 4,690,299 | A | 9/1987 | Cannon |
| 4,699,809 | A | 10/1987 | Maruhashi et al. |
| 4,713,266 | A | 12/1987 | Hasegawa et al. |
| 4,714,580 | A | 12/1987 | Maruhashi et al. |
| 4,719,022 | A | 1/1988 | Hyde |
| 4,803,005 | A | 2/1989 | Juhlke et al. |
| 4,828,727 | A | 5/1989 | McAninch |
| 4,839,067 | A | 6/1989 | Jansen |
| 4,851,287 | A | 7/1989 | Hartsing, Jr. |
| 4,855,162 | A | 8/1989 | Wrasidlo et al. |
| 4,874,647 | A | 10/1989 | Yatsu et al. |
| 4,919,984 | A | 4/1990 | Maruhashi et al. |
| 4,925,583 | A | 5/1990 | Juhlke et al. |

(Continued)

FOREIGN PATENT DOCUMENTS

| | | | |
|---|---|---|---|
| CA | 1157456 | A | 11/1983 |
| DE | 39 05 548 | | 9/1990 |
| DE | 42 06 506 | | 9/1993 |
| DE | 44 23 203 | A1 | 1/1995 |
| EP | 0 359 330 | | 3/1990 |
| EP | 0 372 628 | | 5/1993 |
| EP | 0 629 234 | | 11/1995 |
| EP | 0 844 299 | | 5/1998 |
| GB | 1564128 | | 4/1980 |
| JP | 57003892 | | 1/1982 |
| JP | 6-136377 | | 5/1994 |
| JP | 10053679 | A | 8/1996 |
| NL | 9300742 | | 5/1993 |
| WO | WO 94/03562 | | 2/1994 |
| WO | WO 96/08601 | | 3/1996 |
| WO | WO 01/07544 | A1 | 2/2001 |

OTHER PUBLICATIONS

"A fracture mechanics approach to environmental stress cracking in poly(ethyleneterephthalate)," *Polymer,* vol. 39 No. 3, pp. 75–80 (1998).

"Environmental Stress Cracking Resistance of Blow Molded Poly(Ethylene Terephthalate) Containers," *Polymer Engineering and Science,* vol. 32, No. 6, pp. 393–399 (Mar. 1992).

"Environmental Stress Cracking in PET Carbonated Soft Drink Containers," Eric J. Moskala, Ph.D., Eastman Chemical Company, presented at Bev Tech 98 (Savannah, GA).

Huber et al. "Silicone Oils: Synthesis, Production, Characteristics, and Applications". Presented at the 4$^{th}$ Annual Internal Colloquium "Synthetic Lubricants and Operating Fluids", Technical Academy of Esslingen, Jan. 10–12, 1084, Ostifildern, and English translation.

Lubrication and Lubricants, *Encyclopedia of Chemical Technology,* vol. 15, pp. 463–517.

"The Alternative to Soap and Water for Lubricating Conveyor Lines," *Food & Drink Business,* pp. 35–36 (Jan. 1998).

*Primary Examiner*—Jerry D. Johnson
(74) *Attorney, Agent, or Firm*—Merchant & Gould P.C.

(57) ABSTRACT

The invention relates to the use of formulations containing selected fluorinated components for reducing friction between conveyor systems and the containers transported thereon.

26 Claims, No Drawings

U.S. PATENT DOCUMENTS 4,929,375 A 5/1990 Rossio et al.
4,980,211 A 12/1990 Kushida et al.
4,990,283 A * 2/1991 Visca et al. ..... 516/30
5,001,935 A 3/1991 Tekkanat et al.
5,009,801 A 4/1991 Wider et al.
5,032,302 A 7/1991 Juhlke et al.
5,061,389 A 10/1991 Reichgott
5,073,280 A 12/1991 Rossio et al.
5,115,047 A 5/1992 Hashimoto et al.
5,145,721 A 9/1992 Kojima et al.
5,160,646 A 11/1992 Scheld
5,174,914 A 12/1992 Gutzmann
5,182,035 A 1/1993 Schmidt et al.
5,191,779 A 3/1993 Imazu et al.
5,211,861 A 5/1993 Lafratta et al.
5,238,718 A 8/1993 Yano et al.
5,317,061 A 5/1994 Chu et al.
5,334,322 A 8/1994 Williams, Jr.
RE34,742 E 9/1994 Maier et al.
5,352,376 A 10/1994 Gutzmann
5,371,112 A 12/1994 Sayre et al.
5,391,308 A 2/1995 Despo
5,486,316 A 1/1996 Bershas et al.
5,509,965 A 4/1996 Harry et al.
5,539,059 A 7/1996 Bierschenk et al.
5,549,836 A 8/1996 Moses
5,559,087 A 9/1996 Halsrud et al.
5,565,127 A 10/1996 Laufenberg et al.
5,576,819 A 11/1996 Furusawa
5,652,034 A 7/1997 Seiner
5,658,619 A 8/1997 Kirschner et al.
5,663,131 A 9/1997 Winicov et al.
5,672,401 A 9/1997 Anglin et al.
5,681,628 A 10/1997 Niederst et al.
5,698,138 A * 12/1997 Visca et al. ..... 516/22
5,698,269 A 12/1997 Carlblom et al.
5,721,023 A 2/1998 Ostapchenko
5,728,770 A 3/1998 Yamamoto et al.
5,783,303 A 7/1998 Tsuei
5,789,459 A 8/1998 Inagaki et al.
5,863,874 A 1/1999 Person Hei et al.
5,869,436 A 2/1999 Lindman
5,876,812 A 3/1999 Frisk et al.
5,925,601 A 7/1999 McSherry et al.
5,932,526 A * 8/1999 Person Hei et al. ..... 508/559
5,935,914 A 8/1999 Theyssen et al.
6,090,761 A 7/2000 Butler et al.
6,207,622 B1 3/2001 Li et al.
6,214,777 B1 4/2001 Li et al.
6,653,263 B1 * 11/2003 Kupper et al. ..... 508/582

* cited by examiner

FLUORINE-CONTAINING LUBRICANTS

This application is a divisional of application Ser. No 09/655,544, filed Sep. 6. 2000, now U.S. Pat. No. 6,653,263 which application(s) are incorporated herein by reference.

This invention relates to the use of formulations containing at least one fluorinated component for reducing the friction between conveyors and the articles transported thereon.

In the food industry and especially in beverage factories, the containers to be filled in the bottling plants are conveyed by conveyors differing in design and constituent materials, for example by platform conveyors or chain-like arrangements which are generally referred to hereinafter as chain conveyors. The conveyors establish the connection between the various optional treatment stages of the bottling process such as, for example, the unpacker, bottle washer, filler, closer, labeller, packer, etc. The containers may assume various forms, more particularly glass and plastic bottles, cans, glasses, casks, beverage containers (kegs), paper and paperboard containers. To guarantee uninterrupted operation, the conveyor chains have to be suitably lubricated to avoid excessive friction with the containers. Dilute aqueous solutions containing suitable friction-reducing ingredients are normally used for lubrication. The chain conveyors are contacted with the aqueous solutions by dipping or spraying, for example, the corresponding lubrication systems being known as dip lubrication or automatic belt lubrication or central chain lubrication systems.

The chain lubricants hitherto used as lubricants are mostly based on fatty acids in the form of their water-soluble alkali metal or alkanolamine salts or on fatty amines, preferably in the form of their organic or inorganic salts.

Whereas both classes of substances can be used without difficulty in dip lubrication, they are attended by a number of disadvantages in the central chain lubrication systems typically in use today. Thus, DE-A-23 13 330 describes soap-based lubricants containing aqueous mixtures of $C_{16-18}$ fatty acid salts and surface-active substances. Soap-based lubricants such as these have the following disadvantages:

1. They react with the hardness ions in water, i.e. the alkaline earth metal ions, and other ingredients of water to form poorly soluble metal soaps, so-called primary alkaline earth metal soaps.
2. A reaction takes place between the soap-based lubricants and carbon dioxide dissolved in water or in the product to be bottled.
3. The in-use solution thus prepared is always germ-promoting.
4. Where hard water is used, ion exchangers have to be employed to soften the water which means an additional source of germs (and is therefore hardly encountered in practice) or, alternatively, products of high complexing agent content have to be used which is ecologically unsafe.
5. Increased foaming occurs which can cause problems in particular at the bottle inspector (automatic bottle control) and results in greater wetting of the transport containers.
6. Most of these products contain solvents.
7. The cleaning effect of the products is poor so that separate cleaning is necessary.
8. Corresponding soap-based lubricant preparations show pH-dependent performance.
9. In addition, soap-based lubricant preparations are dependent on the water temperature.

10. Soap-based lubricants show poor stability in storage, particularly at low temperatures.
11. The EDTA (ethylenediamine tetraacetate) present in many products is known to have poor biodegradability.
12. Soap-based lubricant preparations are not suitable for all plastic transport containers because, in many cases, they give rise to stress cracking in the transport container.

Besides soap-based lubricants, lubricants based on fatty amines are mainly used. Thus, DE-A-36 31 953 describes a process for lubricating chain-type bottle conveyors in bottling factories, more particularly in breweries, and for cleaning the conveyors with a liquid cleaning composition, characterized in that the chain-type bottle conveyors are lubricated with belt lubricants based on neutralized primary fatty amines which preferably contain 12 to 18 carbon atoms and which have an unsaturated component of more than 10%.

EP-A-0 372 628 discloses fatty amine derivatives corresponding to the following formulae:

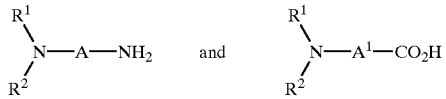

in which $R^1$ is a saturated or unsaturated, branched or linear alkyl group containing 8 to 22 carbon atoms, $R^2$ is hydrogen, an alkyl or hydroxyalkyl group containing 1 to 4 carbon atoms or —A—$NH_2$, A is a linear or branched alkylene group containing 1 to 8 carbon atoms and $A^1$ is a linear or branched alkylene group containing 2 to 4 carbon atoms, as lubricants.

In addition, lubricants based on N-alkylated fatty amine derivatives which contain at least one secondary and/or tertiary amine are known from DE-A-39 05 548.

DE-A-42 06 506 relates to soapless lubricants based on amphoteric compounds, primary, secondary and/or tertiary amines and/or salts of such amines corresponding to general formulae (I), (IIa), (IIb), (IIIa), (IIIb), (IIIc), (IVa) and (IVb):

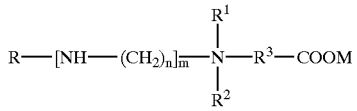

(I)

$R^4$—NH—$R^5$ (IIa)

$R^4$—$N^+H_2$—$R^5X^-$ (IIb)

$R^4$—NH—$(CH_2)_3NH_2$ (IIIa)

$R^4$—NH—$(CH_2)_3N^+H_3$ $X^-$ (IIIb)

$R^4$—$N^+H_2$—$(CH_2)3$—$N^+H_3$ $2X^-$ (IIIc)

$R^4$—$NR^7R^8$ (IVa) and/or $R^4$—$N^+HR^7R^8X^-$ (IVb)

in which

R is a saturated or mono- or polyunsaturated, linear or branched alkyl group containing 6 to 22 carbon atoms which may optionally be substituted by —OH, —$NH_2$, —NH—, —CO—, —$(CH_2CH_2O)_l$— or —$(CH_2CH_2CH_2O)_1$, $R^1$ is hydrogen, an alkyl group containing 1 to 4 carbon atoms, a hydroxyalkyl group containing 1 to 4 carbon atoms or a group —$R^3$COOM, $R^2$ is hydrogen, an alkyl group containing 1 to 4 carbon atoms or a hydroxyalkyl group containing 1 to 4 carbon atoms, but only where M represents a negative charge, $R^3$ is a saturated or mono- or polyunsaturated, linear or branched alkyl group containing 1 to 12 carbon atoms which may optionally be substituted by —OH, —$NH_2$, —NH—, —CO—, —$(CH_2CH_2O)_l$— or —$(CH_2CH_2CH_2O)_1$—, $R^4$ is a substituted or unsubstituted, linear or branched, saturated or mono- or polyunsaturated alkyl group containing 6 to 22 carbon atoms which may contain at least one amine, imine, hydroxy, halogen and/or carboxy group as substituent, a substituted or unsubstituted phenyl group which may contain at least one amine, imine, hydroxy, halogen, carboxy and/or a linear or branched, saturated or mono- or polyunsaturated alkyl group containing 6 to 22 carbon atoms as substituent, $R^5$ is hydrogen or—independently of $R^4$—has the same meaning as $R^4$, $X^-$ is an anion from the group consisting of amidosulfonate, nitrate, halide, sulfate, hydrogen carbonate, carbonate, phosphate or $R^6$—$COO^-$ where $R^6$ is hydrogen, a substituted or unsubstituted, linear or branched alkyl group containing 1 to 20 carbon atoms or alkenyl group containing 2 to 20 carbon atoms, which may contain at least one hydroxy, amine or imine group as substituent, or a substituted or unsubstituted phenyl group which may contain an alkyl group with 1 to 20 carbon atoms as substituent, and $R^7$ and $R^8$ independently of one another represent a substituted or unsubstituted, linear or branched alkyl group containing 1 to 20 carbon atoms or alkenyl group containing 2 to 20 carbon atoms which may contain at least one hydroxy, amine or imine group as substituent, or a substituted or unsubstituted phenyl group which may contain an alkyl group with 1 to 20 carbon atoms as substituent, M is hydrogen, alkali metal, ammonium, an alkyl group containing 1 to 4 carbon atoms, a benzyl group or a negative charge, n is an integer of 1 to 12, m is an integer of 0 to 5 and l is a number of 0 to 5, containing alkyl dimethylamine oxides and/or alkyl oligoglycosides as nonionic surfactants.

EP-B-629 234 discloses a lubricant combination consisting of a) one or more compounds corresponding to the following formula:

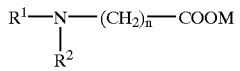

in which $R^1$ is a saturated or mono- or polyunsaturated, linear or branched alkyl group containing 6 to 22 carbon atoms which may optionally be substituted by —OH, —$NH_2$—, —NH—, —CO—, halogen or a carboxyl group, $R^2$ is a carboxyl group containing 2 to 7 carbon atoms, M is hydrogen, alkali metal, ammonium, an alkyl group containing 1 to 4 carbon atoms or a benzyl group and n is an integer of 1 to 6, b) at least one organic carboxylic acid selected from monobasic or polybasic, saturated or mono- or polyunsaturated carboxylic acids containing 2 to 22 carbon atoms, c) optionally water and additives and/or auxiliaries.

WO 94/03562 describes a lubricant concentrate based on fatty amines and optionally typical diluents or auxiliaries and additives, characterized in that it contains at least one polyamine derivative of a fatty amine and/or a salt of such an amine, the percentage content of the polyamine derivatives of fatty amines in the formulation as a whole being from 1 to 100% by weight.

In one preferred embodiment of WO 94/03562, this lubricant concentrate contains at least one polyamine derivative of a fatty amine corresponding to the following general formula:

$$R—A—(CH_2)_k—NH—[(CH_2)_1—NH]_y—(CH_2)_m—NH_2\cdot(H^+X^-)_n$$

in which

R is a substituted or unsubstituted, linear or branched, saturated or mono- or polyunsaturated alkyl group containing 6 to 22 carbon atoms, the substituents being selected from amino, imino, hydroxy, halogen and carboxy, or a substituted or unsubstituted phenyl group, the substituents being selected from amino, imino, hydroxy, halogen, carboxy and a linear or branched, saturated or mono- or polyunsaturated alkyl group containing 6 to 22 carbon atoms, A represents either —NH— or —O—, $X^-$ is an anion of an inorganic or organic acid, k, l and m independently of one another are integers of 1 to 6, y is 0, 1, 2 or 3 where A=—NH— or 1, 2, 3 or 4 where A=—O— and n is an integer of 0 to 6.

Lubricants based on polytetrafluoroethylene are used in some bottling plants. They are present in the form of dispersions and are not applied to the chains in the usual way through nozzles, but instead by brushes. These lubricants have the advantage that they significantly reduce the friction between the conveyor belts and the containers transported thereon. In addition, the polytetrafluoroethylene adheres very strongly to the chains. A disadvantage encountered in practice was that the overall hygienic state in regard to germ population and soiling of the chain conveyors was adversely affected to such an extent that the performance profile of the lubricant gradually deteriorated as a result of the increase in soiling.

Another disadvantage encountered was that the dispersions of polytetrafluoroethylene were not stable in storage and gradually separated. The result of this is that, over a prolonged period, varying amounts of active substance are applied to the chain conveyors.

When an attempt was made to clean the chain conveyors, it was found that the layer of lubricant was very difficult to remove from the chains.

In addition, investigation of the compatibility of polytetrafluoroethylene dispersions with plastics showed that they produce stress cracks in PET bottles.

The problem addressed by the present invention was to provide lubricants based on organic fluorine compounds which, on the one hand, would be stable in storage and, on the other hand, compatible with plastic containers and which at the same time would improve lubricating performance by comparison with the amines typically used as lubricants.

The present invention relates to the use of formulations containing at least one fluorinated component selected from the groups of a) perfluorinated or partly fluorinated monomeric organic compounds, b) pure and mixed dimers and oligomers based on at least one perfluorinated or partly fluorinated organic monomer, c) pure and mixed polymers based on at least one perfluorinated or partly fluorinated organic monomer, the polymer containing at least one monomer unit which contains either less than 70% by weight of fluorine, based on the weight of the total monomer unit, or more than 2 carbon atoms, for reducing the friction between conveyor installations and the containers transported thereon.

According to the invention, the definition of the boundary between oligomers and polymers is based on the generally known characterization of polymers which are made up of so many identical or similar low molecular weight units (monomers) that the physical properties of these substances, particularly their viscoelasticity, do not change significantly when the number of units is increased or reduced by one unit. This is generally the case when the average molecular weight of the "polymers" is 10,000 g/mole or more.

The term oligomers is used for the low molecular weight dimers, trimers and other lower members of the polymer-homolog series.

In one preferred embodiment, group a) comprises at least perfluorinated and partly fluorinated surfactants, alkanes, ethers and amines, the formulations used in accordance with the invention in one particularly preferred embodiment containing ammonium perfluoroalkyl sulfonates, lithium perfluoroalkyl sulfonates, potassium perfluoroalkyl sulfonates, amine perfluoroalkyl sulfonates, sodium perfluoroalkyl sulfonates, potassium fluoroalkyl carboxylates, quaternary fluorinated alkyl ammonium iodides, ammonium perfluoroalkyl carboxylates, fluorinated alkyl polyoxyethylene ethanols, fluorinated alkyl alkoxylates, fluorinated alkyl esters in concentrations of 0.001 to 10%. The fluorinated components of group c) are preferably perfluorinated and/or partly fluorinated alkoxy polymers which, in one particularly preferred embodiment, are obtainable from the copolymerization of tetrafluoroethylene and perfluoroalkoxyvinyl ethers.

In another preferred embodiment, the formulations to be used in accordance with the invention contain at least perfluorinated and/or partly fluorinated polyethers from group c).

In another preferred embodiment, the formulations to be used in accordance with the invention are present in the form of solutions, gels, emulsions, pastes, dispersions.

In one preferred embodiment, the formulations to be used in accordance with the invention additionally contain at least one antimicrobial component selected from the groups of alcohols, aldehydes, antimicrobial acids, carboxylic acid esters, acid amides, phenols, phenol derivatives, diphenyls, diphenyl alkanes, urea derivatives, oxygen and nitrogen acetals and formals, benzamidines, isothiazolines, phthalimide derivatives, pyridine derivatives, antimicrobial surface-active compounds, guanidines, antimicrobial amphoteric compounds, quinolines, 1,2-dibromo-2,4-dicyanobutane, iodo-2-propynyl butyl carbamate, iodine, iodophors, peroxides, the formulations to be used in accordance with the invention in one particularly preferred embodiment containing one or more compounds selected from ethanol, n-propanol, i-propanol, butane-1,3-diol, phenoxyethanol, 1,2-propylene glycol, glycerol, undecylenic acid, citric acid, 2-benzyl-4-chlorophenol, 2,2'-methylene-bis-(6-bromo-4-chlorophenol), 2,4,4'-trichloro-2'-hydroxydiphenyl ether, N-(4-chlorophenyl)-N-(3,4-dichlorophenyl)-urea, N,N'-(1,10-decanediyldi-1-pyridinyl-4-ylidene)-bis-(1-octaneamine)-dihydrochloride, N,N'-bis-(4-chlorophenyl)-3,12-diimino-2,4,11,13-tetraazatetradecane diimidoamide, quaternary ammonium compounds or alkyl amines, guanidines, amphoteric surfactants as antimicrobial components.

Whereas stable formulations of polytetrafluoroethylene dispersions and antimicrobial components are very difficult or impossible to obtain, the formulations containing antimicrobial components to be used in accordance with the invention generally give stable formulations.

In another preferred embodiment, the formulations to be used in accordance with the invention additionally contain at least one component selected from the group of polyhydroxy compounds, more particularly from the groups of polyalcohols and carbohydrates, and—in one most particularly preferred embodiment—a component selected from polyhydric alcohols, preferably alkanediols, alkanetriols, more particularly glycerol, and the polyethers derived therefrom and glucose, arabinose, ribulose, fructose and the oligo- and/or polysaccharides derived therefrom and their esters and ethers.

In another preferred embodiment, the formulations to be used in accordance with the invention contain other components selected from the groups of surfactants and solubilizing agents, at least one alkyl polyglycoside being present as surfactant in a particularly preferred embodiment. Other preferred constituents are fatty alkylamines and/or alkoxylates thereof, more particularly cocofatty amine ethoxylates, and/or imidazoline compounds and/or amphoteric surfactants and/or nonionic surfactants and/or ether carboxylic acids and/or ether amine compounds. In another preferred embodiment, paraffin compounds are added to the formulations to be used in accordance with the invention. The water content of the formulations to be used in accordance with the invention is preferably below 20% by weight and more preferably below 10% by weight, based on the formulation as a whole, the formulations in particularly special embodiments containing no water which, in the context of the invention, means that water is not intentionally added to the formulation. In practice, the formulations to be used in accordance with the invention are applied to the chain conveyors. In the most favorable case, the transport of the containers on the conveyors is not accompanied by foaming. By comparison with conventional lubricants which are diluted with water by a factor of more than 100 in automatic conveyor installations, the formulations to be used in accordance with the invention reduce frictional resistance between the conveyor and the containers transported thereon by more than 20% by for the same quantities by weight of active lubricating components applied to the conveyor installation over a certain period of time. This is demonstrated by the following Examples.

EXAMPLE 1

A comparison formulation 1 which contains 5% by weight of coconut propylenediamine and which is adjusted to pH 7 with acetic acid is applied to the chain conveyors in a concentration in water of 0.2% through a nozzle block comprising five nozzles each capable of spraying 5 liters per hour. 50 ml of the comparison formulation or ca. 2.5 g of the coconut propylenediamine are thus applied to the conveyor chains over a period of 1 hour. This test is carried out for 10 hours. According to the invention, the coefficient of friction between the bottles and the stainless steel conveyor chains is defined as the ratio of the tractive weight applied, for example, to a spring balance when an attempt is made to hold a bottle still while the conveyor is moving to the weight of that bottle.

Where the Comparison Example described above is used, the coefficient of friction $\mu$ is 0.10. When spraying is stopped, the friction coefficient increases rapidly and the bottles fall over after only a few minutes.

In the Comparison Example, a total of 25 ml of lubricating coconut propylenediamine raw materials is applied to the conveyor chains over the total test duration of 10 hours. In a second test, 25 ml of a formulation to be used in accordance with the invention consisting of 5% by weight of perfluoropolyether and 95% by weight of glycerol is distributed over the chain conveyors with a cloth. The coefficient of friction between the bottles and the chain conveyor is then measured over a period of 10 hours under exactly the same conditions as in Comparison Example 1. The coefficient of friction $\mu$ is between 0.04 and 0.05 over the entire test duration of 10 hours. This Example shows that the friction coefficient between the bottles and the conveyor system can be reduced by more than 20% and, in the present case, even by more than 40%.

Another preferred embodiment of the present invention is the use of the formulations to be used in accordance with the invention for the conveying of plastic containers, the plastic containers in one particularly preferred embodiment containing at least one polymer selected from the groups of polyethylene terephthalates (PET), polyethylene naphthenates (PEN), polycarbonates (PC), PVC. In one most particularly preferred embodiment, the containers are PET bottles. In a laboratory test, the stress cracking of a Comparison Example based on 5% polytetrafluoroethylene dispersion is measured by comparison with a 5% perfluoropolyether solution in 95% glycerol.

EXAMPLE 2

According to the test specification, PET bottles are filled with water and conditioned with carbon dioxide in such a way that a pressure of about 7 bar is present inside the bottles. The base cups of the bottles are then dipped in the formulation of the Comparison Example and the Example to be used in accordance with the invention and are placed in a Petri dish for 24 hours. Thereafter the bottles are opened, emptied and their base cups are rinsed with water. Visual inspection of the base cups of the bottles shows that, in the test with the Comparison Example, many stress cracks of average depth (classification C) are present whereas the test with the Example to be used in accordance with the invention produces only a few stress cracks of minimal depth (classification A). The stress cracks are classified in accordance with the reference images appearing in Chapter IV-22 of the book entitled "CODE OF PRACTICE—Guidelines for an Industrial Code of Practice for Refillable PET Bottles", Edition 1, 1993–1994.

Example 2 shows that the formulations to be used in accordance with the invention have advantages over polytetrafluoroethylene dispersions in the conveying of plastic bottles.

In another preferred embodiment, the formulations to be used in accordance with the invention are used for conveying paperboard packs.

In another preferred use, the conveying surfaces of the conveyor belts are made of plastic—in one particularly preferred embodiment of polyacetal and polyethylene.

In another preferred embodiment, the conveying surfaces of the conveyor belt are made of metal—in one particularly preferred embodiment stainless steel.

In another preferred embodiment, additional antimicrobial agents, more particularly organic peracids, chlorine dioxide or ozone, are additionally incorporated in the formulations to be used in accordance with the invention through separate feed systems either before or after application of the formulations.

In another preferred embodiment, the formulations to be used in accordance with the invention are applied to the conveyor belts without dilution with water using an aid selected from paint brushes, sponges, rollers, cloths, brushes, wipers, rubber, spray nozzles. In another preferred embodiment, the formulations to be used in accordance with the invention are diluted with water in automatic conveyor systems and the resulting solution is applied to the conveyors through metering systems, the dilution factor being between 10,000 and 100. In another preferred embodiment, the formulations to be used in accordance with the invention are selected and applied in such a way that there is no further proliferation of microorganisms on surfaces in contact with the formulations or solution. In one most particularly preferred embodiment, the number of microorganisms is reduced.

The formulations to be used in accordance with the invention are preferably used for the conveying of containers in the food industry. In particularly preferred cases, soil occurring is repelled by the conveyor belts conditioned with the formulation, the consumption of water is reduced by at least 80% and no lubricant drips onto the floor providing the lubricants are properly applied to the chain conveyors.

What is claimed is:

1. A method of lubricating the interface between a container and a moving conveyor surface, the method comprising forming an amount of a liquid lubricant composition between a container and a contact surface of the moving conveyor, the lubricant comprising an aqueous solution comprising a polymer comprising units derived from at least one fluorinated organic monomer, the monomer containing less than 70 wt % fluorine.

2. The method of claim 1 wherein the polymer comprises a copolymer of tetrafluoroethylene and a perfluoroalkoxy vinyl ether as an alkoxy substituted polymer.

3. The method of claim 1 wherein the composition comprises a liquid emulsion.

4. The method of claim 1 wherein the composition additionally comprises at least one antimicrobial comprising an alcohol, an aldehyde, an antimicrobial acid, a carboxylic acid ester, an acid amide, a phenol, a diphenyl, a diphenyl alkane, a urea, an oxygen and nitrogen acetal or formal, a benzamidine, an isothiazoline, guanidine, a quinoline, a 1,2-dibromo- 2,4-dicyanobutane, an iodo-2-propynyl butyl carbamate, iodine, an iodophor, a peroxide or mixtures thereof.

5. The method in claim 1 wherein the compositions comprise an antimicrobial compound comprising ethanol, n-propanol, i-propanol, butane-3-diol, phenoxyethanol, 1,2-propylene glycol, glycerol, undecylenic acid, citric acid, 2-benzyl-4-chlorophenol, 3,3'-methylene-bis(6-bromo-4-chlorophenol), 2,4,4'-trichlor-2'-hydroxydiphenyl ether, N-(4-chlorophenyl)-N-(3,4-dichlorophenyl)-urea, N,N'-(1,10-decanediyldi-1-pyridinyl-4-ylidene)-bis-(1-octaneamine)-dihydrochloride, N,N'-bis(4-chlorphenyl)3, 12-diimino-2,4,11,13-tetraazatetradecane diimidoamide, quaternary ammonium compound, alkyl amine, guanidine, amphoteric surfactant or mixtures thereof.

6. The method of claim 1 wherein the composition additionally comprises at least one fluorine free polyhydroxy compound.

7. The method of claim 6 wherein the composition comprises a surfactant or a solubilizing agent.

8. The method of claim 6 wherein the lubricant comprises an alkyl polyglycoside.

9. The method of claim 6 wherein the polyhydroxy compound comprises a polyalcohol or a carbohydrate.

10. The method of claim 9 wherein the polyalcohol comprises an alkanediol, alkanetriol or mixtures thereof.

11. The method of claim 1 wherein the composition has a water content of less than 20% by weight, based on the formulation as a whole.

12. The method of claim 1 wherein the water content is below 10% by weight, based on the composition as a whole.

13. The method of claim 1 wherein in the use of the fluorine polymer lubricant when compared to the same quantities of a coco propylene diamine lubricant, each lubricant diluted with water by a factor of more than 100 in automatic conveyor installations, the frictional resistance between the conveyor and the containers transported thereof is reduced by more than 20%.

14. The method of claim 1 for the conveying of a plastic container.

15. The method of claim 14 wherein the plastic containers contain at least one polymer selected from the groups of polyethylene terephthalate (PET), polyethylene naphthenate (PEN), polycarbonate (PC) or polyvinyl chloride (PVC).

16. The method of claim 14 wherein the plastic container comprises PET.

17. The method of claim 1 for the conveying of a paperboard pack.

18. The method of claim 1 wherein the conveying surfaces of the conveyor system are made of plastic.

19. The method of claim 1 wherein the contact surfaces of the conveyor system are made of metal.

20. The method of claim 1 wherein the method comprises a step of adding an antimicrobial agent separately added to the conveyor during application of the lubricant.

21. The method of claim 20 wherein the antimicrobial comprises an organic peracid, chlorine dioxide or ozone.

22. The method of claim 1 wherein the composition is applied without preliminary dilution using a brush, a sponge, a roller, a cloth, a wiper, a rubber or spray unit.

23. The method of claim 1 wherein the lubricant is diluted with water in automatic conveyor system and the resulting solution is applied to the conveyor belts through metering systems.

24. The method of claim 23 wherein there is about one part of lubricant per each 100 to 10,000 parts of diluent.

25. The method of claim 1 wherein the number of microorganisms on surfaces in contact with the formulations or solutions is reduced.

26. The method of claim 1 for the conveying of a food container.

* * * * *